US005392806A

United States Patent [19]

Gallant

[11] Patent Number: 5,392,806

[45] Date of Patent: Feb. 28, 1995

[54] FOOT VALVE ASSEMBLY FOR LAKE AND RIVER WATER INTAKE

[76] Inventor: Mark Gallant, 24 Purnell Drive, Hamilton, Ontario, Canada, L9C 4Y2

[21] Appl. No.: 207,735

[22] Filed: Mar. 8, 1994

[51] Int. Cl.[6] ..... E03B 3/04

[52] U.S. Cl. ..... 137/236.1; 137/545; 137/590

[58] Field of Search ..... 137/236.1, 545, 549, 137/561 R, 590

[56] References Cited

U.S. PATENT DOCUMENTS

| | | | |
|---|---|---|---|
| 857,519 | 6/1907 | Foster | 137/590 X |
| 1,209,800 | 12/1916 | Barber | 137/236.1 |
| 1,955,308 | 4/1934 | Naftel et al. | 137/590 X |
| 2,776,169 | 1/1957 | Aschenbrenner | 137/236.1 X |
| 4,603,553 | 8/1986 | Ridgeway | 137/236.1 X |
| 5,082,013 | 1/1992 | Scheib | 137/236.1 X |
| 5,257,643 | 11/1993 | Merrett | 137/236.1 |

FOREIGN PATENT DOCUMENTS

| | | | |
|---|---|---|---|
| 1773983 | 11/1992 | Russian Federation | 137/236.1 |

*Primary Examiner*—John Rivell

[57] ABSTRACT

An improved foot valve assembly for use with a water intake includes a bucket with an internal conduit having a connector for attachment to a water pump intake pipe at the base of the bucket. Ballast weight added to the bottom of the bucket provides stability. The intake of water occurs at the upper end of the internal conduit, through a vertically supported foot valve. A basket-fitted over the foot valve may support a fabric bag-filter.

7 Claims, 3 Drawing Sheets

FOOT VALVE ASSEMBLY FOR LAKE AND RIVER WATER INTAKE

FIELD OF THE INVENTION

This invention relates to a foot valve assembly for water intakes that are placed along the bottom of a river or lake. More particularly, it relates to a foot valve that is incorporated into a portable intake stand suited for use at cottages that is intended to reduce the uptake of bottom sediments when water is pumped from a lake or river.

BACKGROUND OF THE INVENTION

A foot valve is a one-way check valve located at the intake end of a pipe leading to a suction pump. The function of a foot valve is to prevent the loss of priming water when the pump is not in operation. Typical foot valves have a surrounding screen to prevent the intake of large articles that would damage a pump. Such valves are also usually of the same diameter as the pipe to which they are to be connected, rendering them suitable for use at the bottom, or "foot" of a well hole.

Water intake stands for introducing water into a pipe are intended to minimize the intake of sediment and debris from river and lake bottoms. A concern respecting water intake stands is that they should locate the intake near, but not at the bottom of the water body, and they should not protrude substantially above the bottom to an extent that makes them vulnerable to being upset by currents, or by fisherman's lines or anchors.

A basic known way of supporting and stabilizing a water intake is to fasten the intake end of a pump pipe to a box with a perforated lid filled with gravel that is sunk to the bottom of a river or lake bed. This fastening is effected along the upper edge of the box thereby causing the pump pipe to trail downwardly to the bottom as it proceed towards the shore where a suction pump is located. Such an elevated pipe section is vulnerable to being snagged by fishermen's lines or anchors, risking detachment from, or up-ending of, the box.

A simple known commercial stand is that produced by Wally Weights Inc. of Kenora, Ontario, Canada. In one version, the Wally Weight (TM) stand consists of a plastic "wheel" with the water intake occurring at the axle location. With a rigid length of intake pipe extending as an axle, the wheel lies on the lake bottom with the intake orifice elevated above the bottom. Provision is made at the intake opening in this stand for a foot valve to be attached. In use, the foot valve would be oriented at an angle between the horizontal and vertical positions.

A second version of a water intake stand from the same source provides for a cone that rises to the pipe intake at its center point. The cone and intake pipe are perforated to allow water to pass therethrough and enter a submersible pump located in the vertically extending central pipe portion of the stand. Such pumps do not always need a foot valve, although one may optionally be present.

Another company selling water intakes is the Big Foot. Manufacturing Co. of Cadillac Mich. U.S.A. The Big Foot(TM) intake is in the form of two concentric perforated cylinders having an annulus therebetween. This annulus is filled with pea-sized gravel to strain water passing through to the core where the intake orifice is located.

While these prior art water intakes are able to function as intended, neither fully address the desirable objectives of providing an assembly for supporting a foot valve in conjunction with a water intake stand which is readily portable prior to installation, is relatively stable and anchored once installed along a lake or river bottom and provides a positioning means for locating the intake orifice above the actual bottom of the water source. It is with the objective of providing such a combination of benefits that the invention described hereafter has been conceived.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention in one of its broader aspects comprises a container having a bottom and sidewalls, there being positioned therein an intake conduit for conveying water that has upper and lower ends. The lower end of the intake conduit passes through and is anchored to the side wall of the container at a location proximate to the container bottom. The lower end terminates in an external coupling means for connection to a water pump intake pipe. The upper end of the intake conduit is positioned above the bottom of the container, at a distance spaced therefrom sufficient to provide for a ballasting mass to be placed within the container, over the container bottom and beneath the upper end of the conduit. To the upper end of the conduit may be attached by way of coupling means on the conduit, a check valve, such as a foot valve, held in a vertical orientation to receive water that is not being drawn from adjacent the river or lake bottom where sediments will be present.

In a preferred variant the container has a removable lid which, when in place, is pierced by the upper end of the intake conduit preferably at a central location, stabilizing the conduit in its position within the container.

In a preferred configuration, the container is a bucket with a handle that permits suspension of the bucket in an upright orientation from a single suspension point, as by a lifting line.

As further variants, the upper end of the intake conduit may be fitted with an encircling screen mounted above the upper rim of the container, containing the foot valve, to provide screening means to prevent the intake of pieces of solid matter. Fabric filter bags may further be fitted over this screen to reduce the size of particles entering the pump intake.

As a further convenience, the bottom of the container may be perforated to allow for flooding and drainage when the container is introduced into or removed from the water.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENTS

Figure 1:
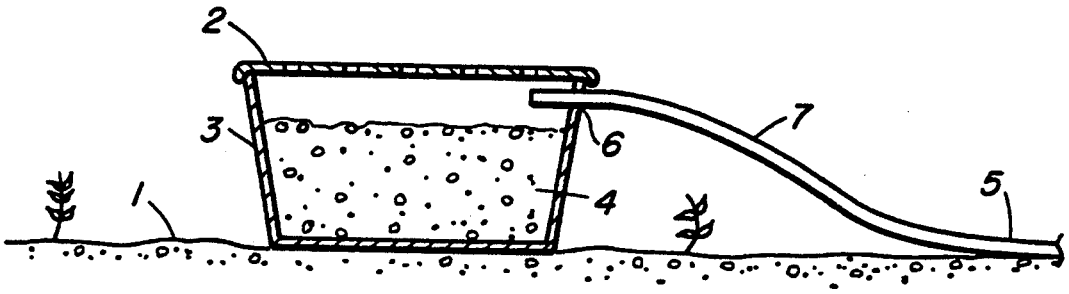
PRIOR ART FIG. 1
FIG. 1 is a depiction of a prior art box of gravel to which is fastened a water pump intake pipe.

In FIG. 1 along a river bottom 1 a box 3 containing gravel 4 is fastened through a hole 6 in the box wall to a water pump intake pipe 5. Water enters the pipe 5 above the gravel 4 beneath a perforated lid 2, at a position located above the river bottom 1. This is a prior art arrangement that has the disadvantage that a trailing portion 7 of the pipe 5 is elevated above the bottom 1, where it can be accidentally snagged.

Figure 2:
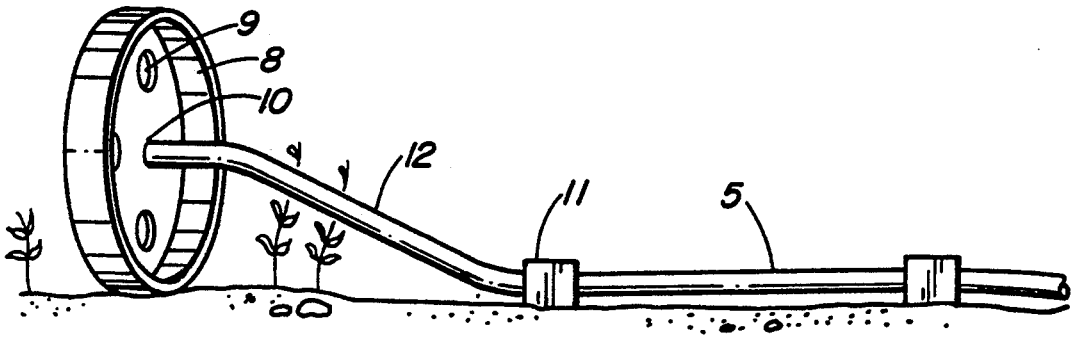
PRIOR ART FIG. 2
FIG. 2 is a schematic depiction of a Wally Weight company "wheel"-type water intake stand.

In FIG. 2 the prior art Wally Weight "wheel" configuration is depicted. A wheel 8 with perforations 9 has the pipe 5 connected at its axial location 10. Weights 11 endeavour to hold the pipes to the bottom 1, shortening the length of elevated pipe 12. A foot valve (not shown) may be connected to the pipe 5 at the open end of the axial location.

Figure 3:
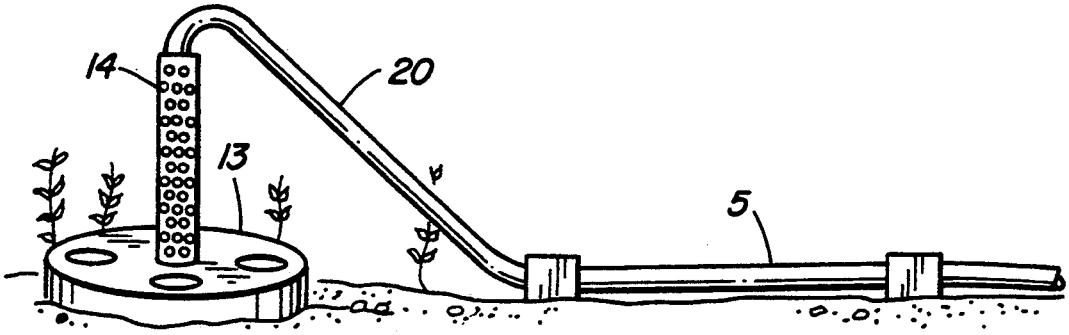
PRIOR ART FIG. 3
FIG. 3 is a schematic depiction of a second Wally Weight intake stand with a vertically oriented intake pipe.

In FIG. 3, the second prior art Wally Weight configuration is shown. The "wheel" 13, which may be cone shaped, has a vertical perforated pipe 14 attached thereto into which may be slid a pump intake 5 or even a down-hole pump (not shown). Again, a portion 20 of pipes is elevated above the bottom 1.

Figure 4:
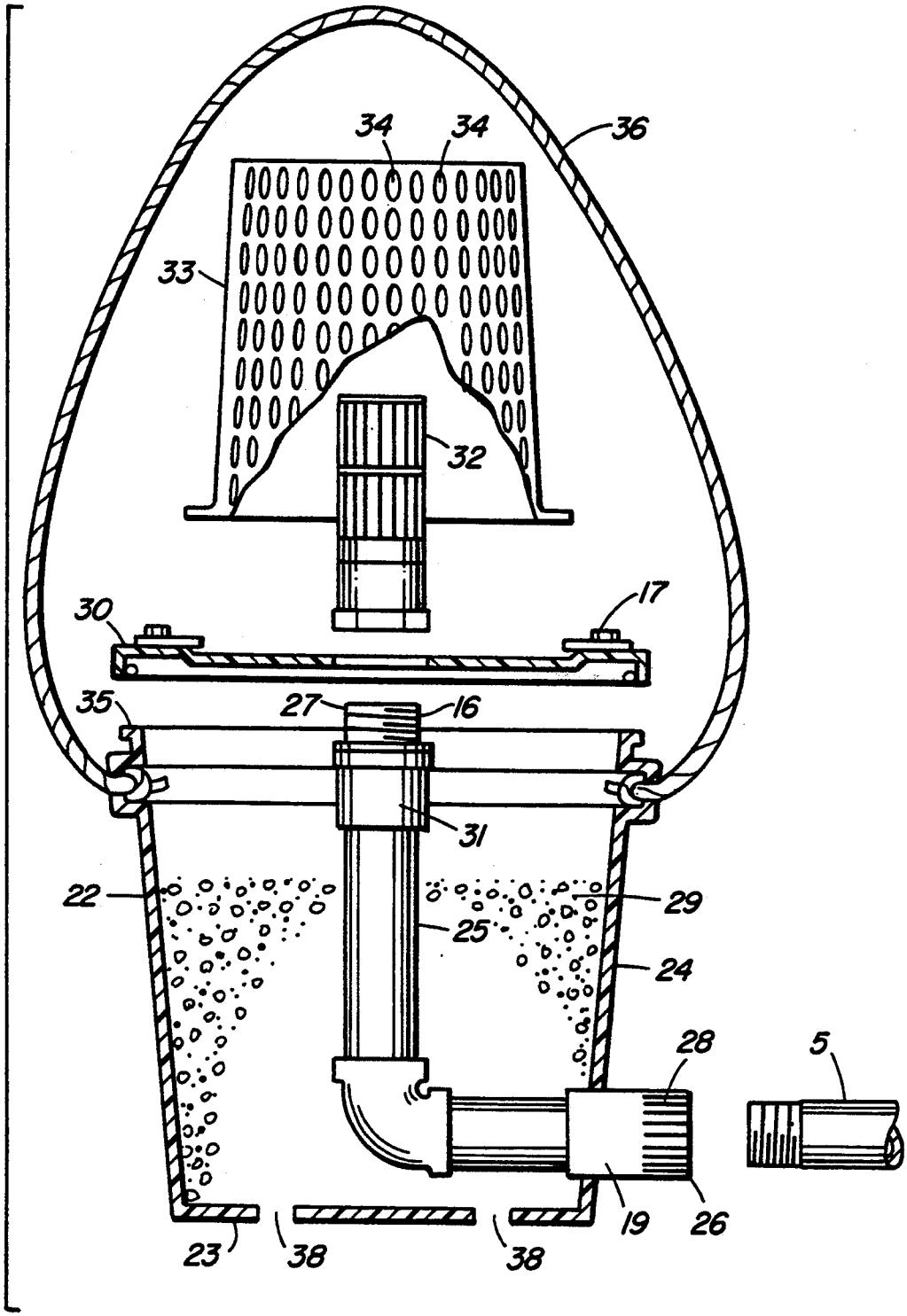
FIG. 4 is a cross-sectional exploded side view of a water intake stand according to the invention.

In FIG. 4 a water intake according to the invention is shown. A container in the form of a plastic bucket 22 has a bottom 23 and sidewall 24. An intake conduit 25 generally positioned within the bucket 22 has lower 26 and upper 27 ends.

The lower end 26 passes through the sidewall 24 being held in place by a collar 19. This lower end 26 terminates with a coupling means 28, such as a thread, for connecting to a water pump intake pipe 5.

The upper end 27 of the intake conduit 25 is centrally positioned above the bottom 23, sufficiently elevated to permit a portable ballast 29 such as stones to be placed below it. Preferably, a lid 30 fitted over the bucket 22 is pierced centrally by the upper end 27 of the conduit 25. This lid not only serves to contain the ballast 29 if the bucket 22 tips but also provides structural support and stabilization to the conduit 25. A collar 31 at the upper end 27, in turn supports the lid 30.

A check valve 32 of the foot valve type may be attached to the upper end 27 of the intake conduit 25. This may optionally be provided as part of the product at the time of sale, or be attached by the purchaser using the coupling means, e.g. threaded end 16, provided at the upper end 27 of the conduit 25.

A basket 33 with straining openings 34 is fitted over the bucket 22 to strain-out coarse particles, conveniently engaging with the lid 30 near the rim 35 of the bucket 22 through use of attachment flanges 17. The diameter of the bucket's rim 35 permits a large basket 33 to be employed, providing a substantial area for straining and entry of water. The basket 33 encloses entirely the foot valve 32 protecting it from being struck directly, as by an anchor.

Figure 5:
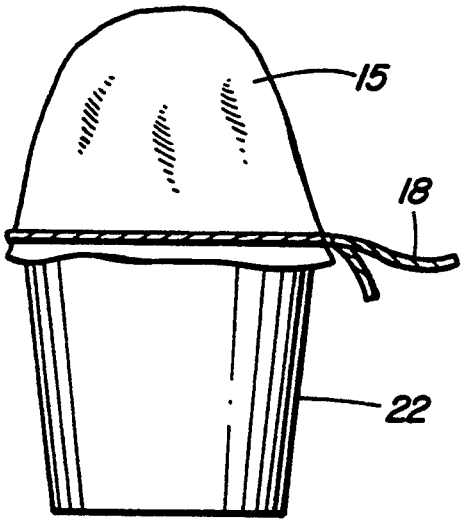
FIG. 5 is a depiction of the water intake stand with a fabric bag-filter fitted in place.

As shown in FIG. 5, a fabric filter in the form of a hood or bag 15 can be attached over the basket 33, held in place by a tied cord 18 fastened around the container rim 35. Such hood 15 if made of a fine material will provide further filtration and screening of particles to prevent their entry into the pump intake pipe 5.

Figure 6:
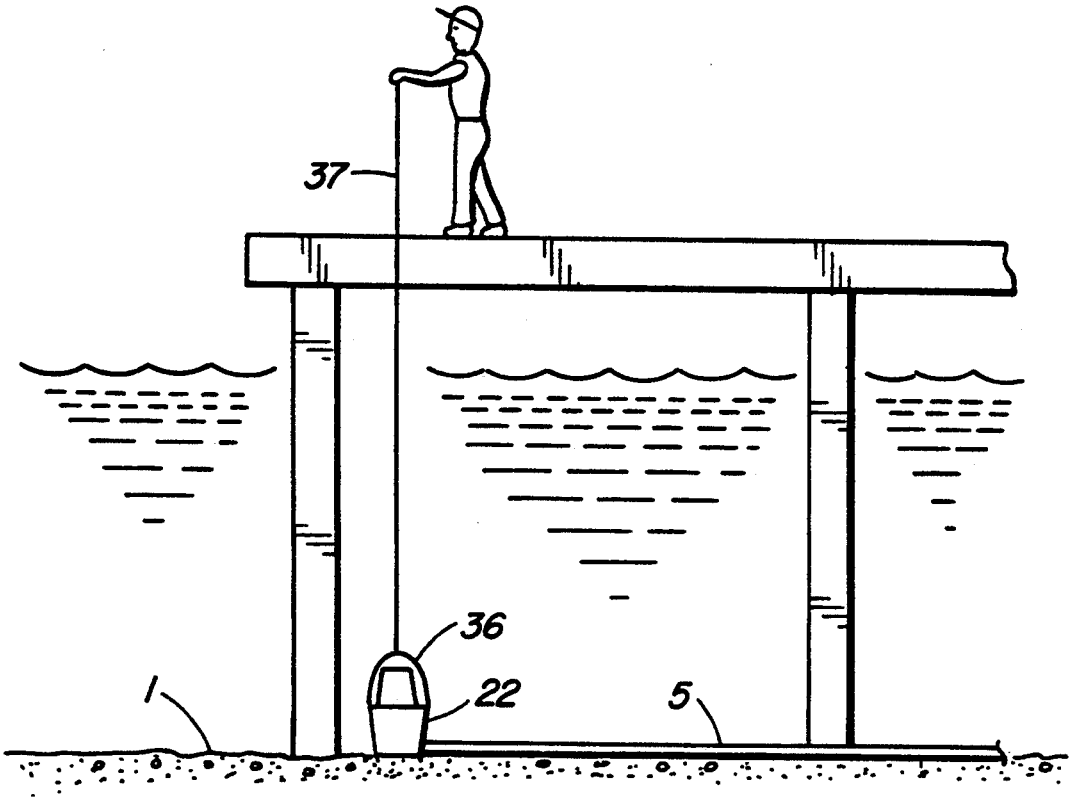
FIG. 6 is a pictorial view of the water intake stand of the invention being positioned on a lake bottom, adjacent to a dock.

The bucket 22 preferably has a hooped handle 36 as by a cord or wire that permits it to be suspended in a vertical orientation by a line 37, as shown in FIG. 6. Perforations 38 in the bottom 23 of the bucket 22 allow it to flood and drain readily, maintaining its vertical orientation. The fact that the pipe 5 is connected to the bucket 22 near its bottom 23 also contributes to maintaining this orientation.

The water intake stand of the invention is conveniently portable, being of reduced weight until ballast is added. The actual intake end of the water pump intake with the foot valve in place can be positioned 12 to 15 inches off of the river bottom. Significantly, the water pump intake pipe approaches and enters the water intake stand at the base of the bucket, adjacent the river bottom. This reduces the prospects of this pipe being inadvertently snagged.

Once positioned properly on the river bed 1, the bucket 22 will be stabilized in its orientation by the ballast 29 contained therein and the fact that the intake pipe enters the bucket 22 near its bottom end.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

I claim:

1. A check valve support assembly comprising a container having a bottom panel, sidewalls and an upper open rim, there being positioned therein an intake conduit having upper and lower ends, the lower end of the intake conduit end being positioned to pass through and be anchored by the sidewall of the container at a location proximate to the bottom panel of the container, said lower end terminating in an external coupling means for connection to a water pump intake pipe, the upper end of the intake conduit being positioned above the bottom panel of the container, at a distance spaced therefrom sufficient to provide for a ballasting mass to be placed within the container, over the container bottom panel and beneath the upper end of the conduit, said upper end terminating in coupling means whereby a one-way check valve may be attached thereto.

2. An assembly as in claim 1 having a one-way check valve connected at the upper end of the conduit, said check valve being held in a vertical orientation to receive water from a position above a river or lake bottom when the assembly is placed upon such a bottom.

3. An assembly as in claim 1 comprising a removable lid that is attachable to the container around said upper open rim, the lid being pierced by the upper end of the intake conduit, stabilizing the conduit in its position within the container.

4. An assembly as in claim 1 comprising a handle attached to said container that permits suspension of the container in an upright orientation from a single suspension point, as by a lifting line.

5. An assembly as in claim 4 wherein the bottom of the container is perforated to allow for flooding and drainage when the container is introduced into or removed from the water.

6. An assembly as in claim 1 wherein the upper end of the intake conduit is enclosed by an encircling screen, mounted on the lid or the upper rim of the container, to provide screening means to prevent the intake of pieces of solid matter by said conduit.

7. An assembly as in claim 6 comprising a fabric filter fitted over said screen to reduce the size of particles entering the intake conduit.

* * * * *